United States Patent [19]

Vrijssen et al.

[11] Patent Number: 4,988,928

[45] Date of Patent: Jan. 29, 1991

[54] PICTURE DISPLAY DEVICE

[75] Inventors: Gerardus A. H. M. Vrijssen; Willem Van Alphen, both of Eindhoven, Netherlands

[73] Assignee: U.S. Philips Corporation, New York, N.Y.

[21] Appl. No.: 461,886

[22] Filed: Jan. 8, 1990

[30] Foreign Application Priority Data

Jan. 12, 1989 [NL] Netherlands ..... 8900068

[51] Int. Cl.[5] ..... G09G 1/04; H01J 29/58; H01J 29/46

[52] U.S. Cl. ..... 315/382; 313/414; 313/450

[58] Field of Search ..... 315/382, 370; 313/414, 313/450, 436, 437

[56] References Cited

U.S. PATENT DOCUMENTS 3,375,390 3/1968 Schlesinger ..... 315/382

*Primary Examiner*—Gregory C. Issing

*Attorney, Agent, or Firm*—Robert J. Kraus

[57] ABSTRACT

Picture display device comprising a display tube with an electron gun having a tubular structure with an outer surface and an inner surface on which a helical resistance structure of a material having a high electrical resistance constituting a focusing lens is provided. The outer surface is provided with an electrode of readily electrically conducting material arranged opposite at least a part of the focusing lens for capacitively controlling the focusing lens by means of a dynamically variable voltage the amplitude of which is a function of the position of the electron beam spot on the display screen.

2 Claims, 2 Drawing Sheets

PICTURE DISPLAY DEVICE

BACKGROUND OF THE INVENTION

The invention relates to a picture display device comprising a display tube having a display screen and an electron gun facing said screen and having a cathode centred along an electron-optical axis and a plurality of electrodes which oily constitute a beam-shaping part for generating an electron beam, said gun further comprising a tubular structure having an outer surface and an inner surface on which a helical resistance structure of a material having a high electrical resistance constituting a focusing lens is provided.

A focusing lens constituted by a helical high-ohmic resistance structure for use in display tubes in order to obtain a low spherical aberration is known from literature.

However, problems occur if a dynamic focusing signal is to be applied to this type of focusing lens. Correction by means of applying a dynamic focusing voltage may be necessary, for example, in the case of large deflection angles so as to keep the electron beam in focus throughout the screen (a different focusing voltage is required in the corners than the centre of the screen). The high resistance of the helical lens structure causes particular problems with regard to the dynamic focus if the frequency of the focusing signal exceeds 16 kHz. This is a result of the large intrinsic RC time of the resistance layer, even at those areas where the layer does not constitute a helical structure, but is homogeneous.

SUMMARY OF THE INVENTION

It is one of the objects of the invention to provide a picture display device with a display tube comprising a focusing lens of the type described above, which is suitable for using dynamic focus.

A picture display device according to the invention is therefore characterized in that the outer surface is provided with an electrode of an electrically readily conducting material arranged opposite to at least a part of the resistance structure while voltage-supplying means are provided for applying:

- a static focusing voltage to the resistance structure, and
- a dynamically variable voltage to said electrode, the intensity of said dynamically variable voltage being a function of the position of the electron beam spot on the display screen.

An essential aspect of the invention is that the dynamic correction signal is capacitively coupled in with a metal electrode on the outer side of the envelope in which the helical focusing lens structure is prevent. This electrode may comprises, for example a (preferably closed) coaxial metal cylinder in a sheet or foil shape or in the shape of a deposited layer. It appears that dynamic focusing signals up to frequencies in the MHz range can be sued in this manner.

BRIEF DESCRIPTION OF THE DRAWING

Some embodiments of a picture display device according to the invention will now be described in greater detail with reference to the accompanying drawing figures in which.

DESCRIPTION OF THE PREFERRED EMBODIMENTS

Figure 1:
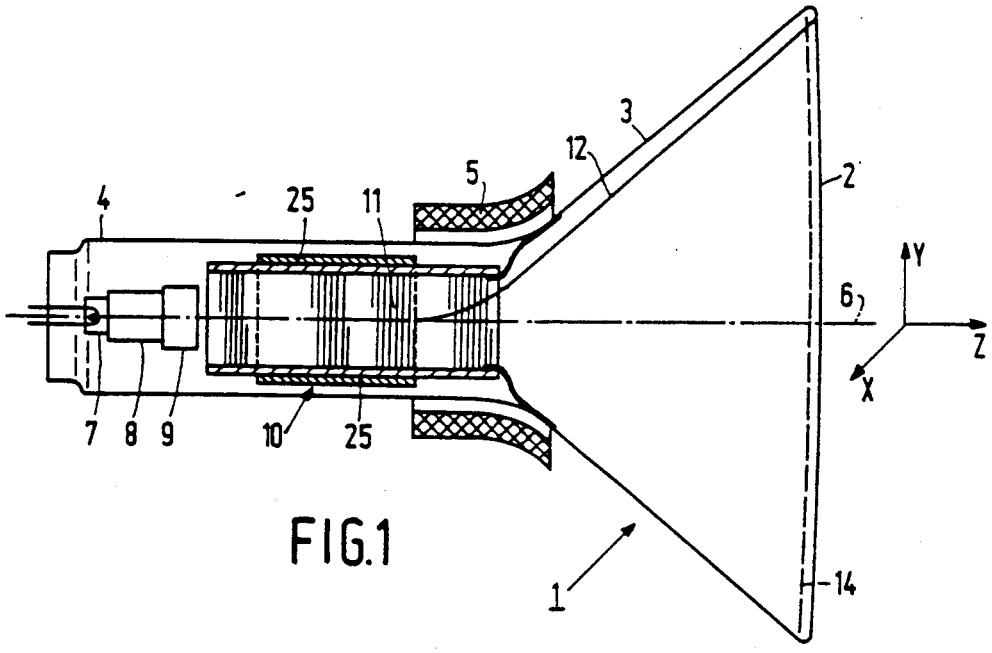
FIG. 1 is a diagrammatic cross-section of a picture display tube according to the invention.

The device shown in FIG. 1 comprises a cathode ray tube having, inner alia, a glass envelope 1 which is composed of s display window 2, a conical portion 3 and a neck 4. This neck accommodates a plurality of electrode structures 8, 9, which together with a cathode 7 constitute an electron gun. The electron-optical axis 6 of the electron gun is also the axis of the envelope. An electron beam 12 is successively formed and accelerated by the cathode 7 and the electrode structures 8, 9. The reference numeral 10 denotes a tubular structure whose inner side bears a helical structure of a material having a very high electrical resistance which constitutes a focusing leans 11 focusing the beam on a display screen 14 on the inner side of the display window 2. Depending o the manner in which voltages are supplied o the helical resistance structure, the focus lens can be e.g. of the uni-potential, the bi-potential or of the tri-potential type. In the case of a bi-potential type the applied voltages are, for example

| | |
|---|---|
| cathode 7 | 50 V |
| electrode 8 | 0 V |
| electrode 9 | 500 V |
| entrance side of focusing lens 11 | 7 kV |
| exit side of focusing lens 11 | 30 kV |

The electron beam 12 is deflected rom the axis 6 across the display screen 14 by means of a system 5 of deflection coils. Display screen 14 comprises a phosphor layer which is coated with a thin aluminum film which is electrically connected to the end of electrode 0 via a conducting coating on the inner wall of the conical portion 3.

Figure 3:
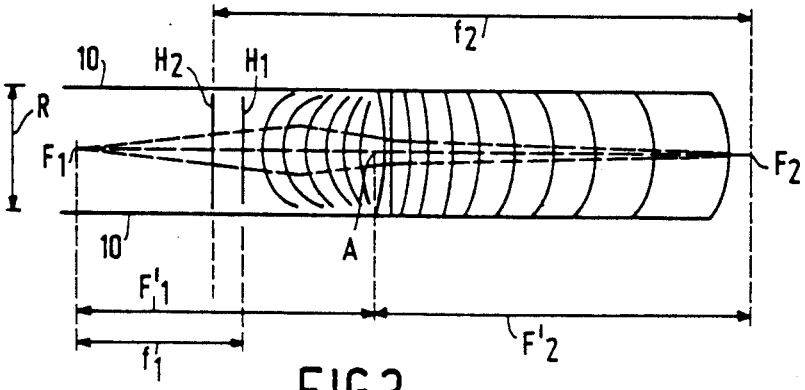
FIG. 3 shows a focusing field which can be generated by means of an electron gun of the type shown in FIG. 2.

FIG. 3 diagrammatically shows an example of a focusing lens field which can be generated by the focusing lens 11. The curved lines represent the lines of intersection of the equipotential planes which are produced by applying a voltage difference across the ends of the helical resistance structure, in the plane of the drawing. Each equipotential plane represents points having an equal "refractive index". The centre of the lens is the point A. The focal lengths $f_1$ and $f_2$ are the distances between the focus $F_1$ and the first main surface $H_1$ and the distance between the focus $F_2$ and the second main surface $H_2$, respectively. The foci $F_1$ and $F_2$ are located at distances $F'_1$ and $F'_2$ respectively, from the centre A. The produced focusing field generally has a portion which has a converging effect on the electron beam followed by a portion which has a diverging effect on the electron beam. In this example the focusing leans constituted by the electrode structure 11 is partly located within the deflection coil system 5. Since the focusing lens is thus less far remote from the display screen than in tubes in which the focusing lens is located in front of the deflection coils, the angular aperture of the beam on the display screen is larger if the electron beam diameter in the focusing lens remains the same, thus with equal aberrations and a given cathode load, so that a smaller electron spot is realised on the display screen. This results in a better resolving power.

Although the focusing lens 11 in the construction according to FIG. 1 is partly located i the field of the deflection coils, because this is favorable of the resolving power of the picture display tube 1, the invention is not limited to such a positioning.

The capacitive coupling in of a dynamic correction signal according to the invention may be used to advantage in all picture display devices comprising cathode ray tubes wtih a focusing lens of the helical resistance type and particularly in projection television display devices.

Figure 2:
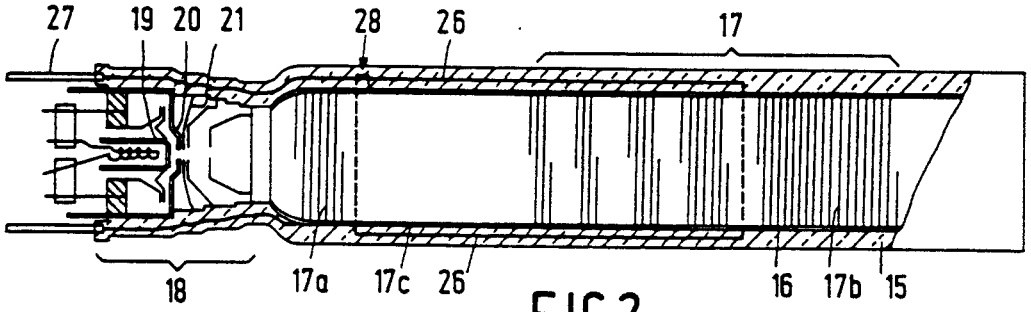
FIG. 2 is an elevational view of a longitudinal section of an electron gun suitable for use in the tube of FIG. 1.

FIG. 2 shows an electron gun of a type suitable for use in the display tube of FIG. 1. The type of question comprises a tubular (glass) envelope 15. A high-ohmic resistance layer 16 is provided on the inner side of the envelope 15, in which layer a helical structure is formed near one end, constituting a focusing lens field 17 when a suitable electric voltage is applied to the ends. The high-ohmic resistance layer 16 may be ; for example glass enamel with a small amount (for example, several % by weight) of metal oxide (particularly ruthenium oxide) particles. The layer 16 may have a thickness of between 1 and 10 $\mu$, for example 3 $\mu$m. The resistance per square of such a layer depends on the concentration of metal oxide and the firing treatment to which the layer is subjected. Resistances per square varying between 10.4 and 10.8 $\Omega$ have been realised in practice. A desired resistance per square can be realised by adjusting he relevant parameters. A resistance per square of the order of $10^6$ $\Omega$ is very suitable for the present application. The total resistance of the helical structure formed in the layer 16 (which structure may be a continuous helix or a plurality of separate helixes connected by segments without a helical structure) may be of the order of 10 G$\Omega$, which means that a current of several micro-amperes will flow across the ends at a voltage difference of 30 kV.

Figure 4:
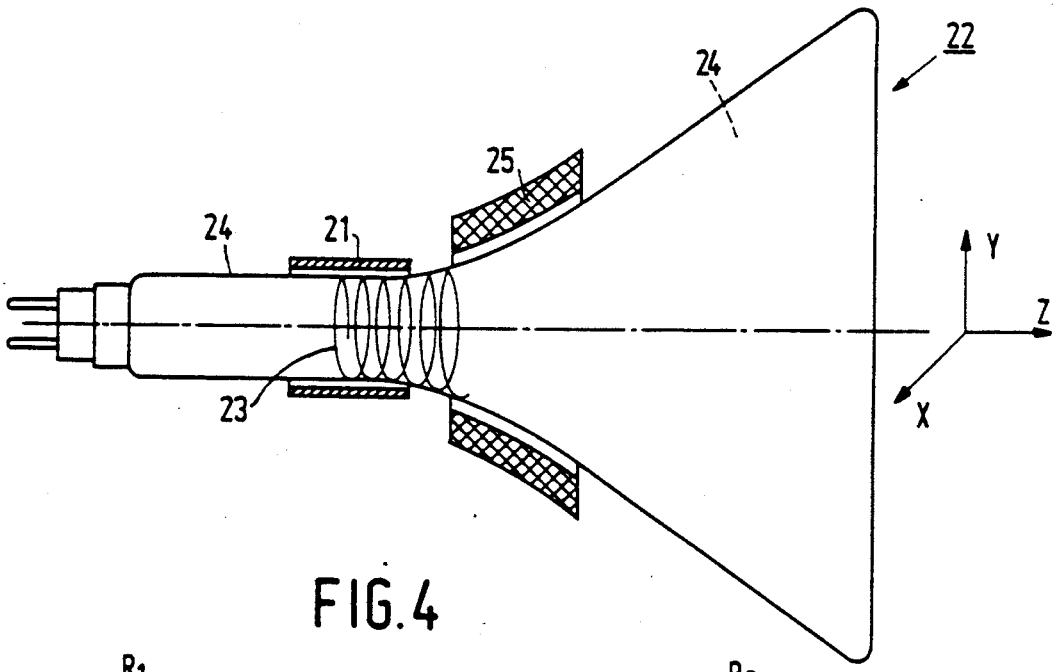
FIG. 4 shows an alternative embodiment of a picture display tube according to the invention in a cross-section.

The electron gun of FIG. 2 comprises a beam-shaping part 18 in front of the focusing lens 17, which part generally comprises a cathode 19, a grid electrode 20 and an anode 21. The components of the beam-shaping part 18 may be mounted in the tubular envelope 15 of the focusing lens 1, as in the gun shown in FIG. 2. Alternatively, they may be mounted outside the tubular envelope of the focusing lens in the display tube, for example, by securing them to axial glass-ceramic mounting rods. The tubular envelop 15 may advantageously be constituted by the neck of the display tue. Such a display tube 22 is shown diagrammatically in FIG. 4. In this case a high-ohmic resistance layer with a helical structure 23 constituting the focusing lens is provided on a part of the inner side of the envelope 24 of the display tube 22.

It may be necessary to correct occurring picture errors (particularly the curvature of field) by means of dynamic focusing. The power of the electron lens for focusing the electron beam is adjusted as a function of the deflection to which the electron beam is subjected at that moment. This makes is possible to have the then prevailing main surface of the image intersect the display screen at that area where the electron beam impinges upon the display screen. This correction method necessitates an extra circuit in the control device for generating the correct dynamic focusing voltages on the electrodes of the focusing lens.

Since the material of the helical resistance track has such a high electrical resistance (for example, 10 G$\Omega$), the RC time is large (for example, 10 msec.). As a result, the effect of the dynamic focusing voltage hardly penetrate the helical resistance structure. The invention provides a solution the form of a capacitive electrode 25 (FIG. 1); 26 (FIG. 2) and 21 (FIG. 4) which is separated by an isolator and surrounds the high-ohmic focusing lens structure. The principle of this solution will be elucidated with reference to FIG. 2.

Figure 5:
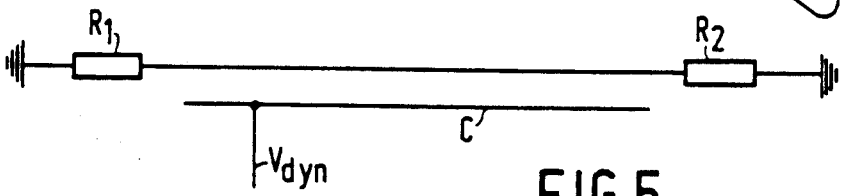
FIG. 5 shows an electrical schematic diagram of the dynamic control of the electron gun of FIG. 2.

The high-ohmic resistance layer 16 on the inner surface of the tubular structure 15 has parts in which a helical pattern is provided and parts without such as pattern so that an optimally static focusing field, particularly with respect to minimum spherical aberration, is obtained when applying a voltage. The dynamic focusing signal is applied to a (tubular) electrode 26 of a satisfactory electrically conducting material. In the embodiment shown this electrode 26 is electrically connected at the point 28 to a supply lead 7 through which the static focusing signal is supplied. A DC voltage applied to point 28 acts on the focusing lens as a normal static focusing voltage. However, the focusing lens behaves in a different manner if the focusing voltage is modulated in time. The part of the inner wall of the tubular structure 15 facing the electrode 26 will tend to follow the potential changes of the electrode 26. The inner wall and the electrode 26 may be considered to be a capacitor, one terminal of which is connected to the focusing signal supply lead and the other terminal of which is connected to the exterior via the helical resistors (*$R_{1\ l\ and\ R2}$) at the ends of the tubular structure. Together with these resistors, the capacitor constitutes an RC network. Variations of the focusing voltages $V_{dyn}$ which are (*much) faster than the corresponding RC time cannot be attenuated and will be coupled in via the capacitor. The electrical schematic is shown diagrammatically in FIG. 5. In this Figure the capacitor plate C coupled to the supply voltage $V_{dyn}$ represents the electrode 26 shown in FIG. 2, the resistors $R_1$ and $R_2$ represents the electrode 26 shown in FIG. 2, the resistors $R_1$ and $R_2$ represent the helical parts of the resistance layer at the side of the beam shaping part (17*a*) and at the side of the screen (17*b*).

A practical example will be described with reference to FIG. 6. In a specific case a metal electrode 29 having a length of 45 mm and a diameter of 11 mm is present on the outer surface of a glass tube 30 having a wall thickness of 0.6 mm. A high-ohmic resistance layer 31 with a helical structure 32 constituting a pre-focusing lens and a helical structure 33 constituting a main focusing lens are provided on the inner surface. The capacitive electrode 29 bridge the space between the structure 32 and 33 and at least a part of the structure 3. The capacitance of the capacitor constituted by the inner wall and the electrode 29 is approximately 45 pF in this case and the total resistance of the helical structures 32, 33 is approximately $0.5\times10^{10}$ Ohm, with a resultant RC time of approximately 240 msec. This means that the inner wall of the tube will follow all voltage variations of the electrode 29 whose characteristic time is shorter than 1900 msec. Unlike FIG. 2, the static focusing voltage $V_{stat\ l}$ *and the dynamic focusing voltage Vdyn* are separately applied int eh situation shown. The construction of FIG. 1 is realised by providing a metal (for example aluminum) foil between two coaxial tubes which constitute the tubular structure 15 after softening and drawing on a mandrel. The electrical contact 28 can be established by pressing the contact strip (27) (FIG. 2) of the focusing electrode supply lead against the aluminium foil during the drawing process.

Figure 6:
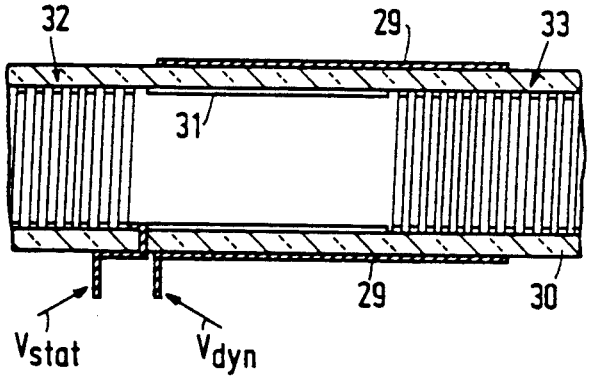
FIG. 6 shows a part of a focusing lens structure suitable for the display tube according to the invention.

Alternatives for the above-described use of an aluminium foil between two coaxial tubes are, for example, vapour deposition of a layer of satisfactory electrically conducting material on the outer surface of a tubular structure 30 as is shown in FIG. 6, or providing a metal cylinder around such a tubular structure 30.

If in the latter case a magnetically conducting material (for example, nickel-iron) is used as a material for the cylinder, the cylinder may also serve as a magnetic shield.

Figure 7:
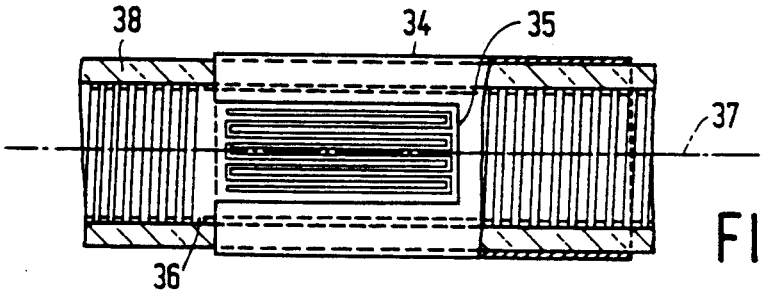
FIG. 7 shows an alternative for the structure of FIG. 6.

The invention is not limited to rotationally symmetrical dynamic focusing. Intersecting possibilities are provided if the capacitive electrode is non-rotationally symmetrical because it has certain elements such as holes, (slanting) slits and the like. These elements may be used for generating dynamic multiple fields in the static focusing lens region. In this way, for example, dynamic dipoles (for beam displacement) and dynamic quadripoles (for correcting astigmatism) can be added. The internal high-ohmic resistance structure is preferably adapted to the correction elements in the external capacitive electrode by means of a meandering or strip-shaped pattern which must ensure that the conducting power of those areas in the resistance layer where the non-rotationally symmetrical corrections are performed is minimal in the rotationally symmetrical direction. Preferably these corrections will be performed in the non-helical part 17*c* of the focusing device, as is shown in FIG. 2. An embodiment is shown in FIG. 7. In this case the capacitive electrode 34 has a non-rotationally symmetrical recess 35. The part of the resistance layer 36 located under this recess is formed as a meandering pattern whose longitudinal direction is parallel to the tube axis 37 of the (glass) cylinder 38.

The picture display tube according to the invention may be used advantageously as a projection TV tube, but in principle it may also be used in colour display tubes. It may alternatively be used for oscilloscope tubes in which the high-frequency deflection could take place, for example by means of a signal which is capacitively coupled in.

We claim:

1. A picture display device comprising a cathode ray tube including a display screen and an electron gun for producing at least one electron beam directed at the screen, said tube being adapted for the attachment of deflection means for deflecting the electron beam across the screen, characterized in that the electron gun comprises:

a. a beam shaping pat including cathode for emitting electrons and electrode means for forming the electrons into said beam;

b. a tubular structure of insulating material through which the electron beam is affected, said tubular structure including an inner surface on which is disposed a helical resistive layer of a material having a high electrical resistance for producing an electrical focusing lens field when a voltage is applied to said resistive layer;

c. a surface electrode disposed on an outer surface of the tubular structure and extending over at least a portion of the helical resistive layer, said surface electrode, said portion of the layer and the insulating material of the tubular structure which is disposed between said surface electrode and said portion forming a capacitor;

d. first voltage supplying means for applying a static focusing voltage to the helical resistive layer to effect static focusing of the electron beam; and e. second voltage supplying means for applying a dynamically variable focusing voltage to the surface electrode, said voltage being coupled through said capacitor to the helical resistive layer to effect dynamic focusing of the electron beam.

2. A picture display device as in claim 1 where the surface electrode is symmetrically disposed around the tubular structure.

* * * * *